US005135406A

United States Patent [19]

Ishikawa

[11] Patent Number: 5,135,406

[45] Date of Patent: Aug. 4, 1992

[54] RECHARGEABLE ELECTRIC APPARATUS

[75] Inventor: Hiroshi Ishikawa, Tokyo, Japan

[73] Assignee: U.S. Philips Corp., New York, N.Y.

[21] Appl. No.: 734,702

[22] Filed: Jul. 23, 1991

[30] Foreign Application Priority Data

Aug. 13, 1990 [JP] Japan ..... 2-214090

[51] Int. Cl.[5] ..... H01R 13/44

[52] U.S. Cl. ..... 439/131; 439/136

[58] Field of Search ..... 439/131, 135, 136, 149, 439/218, 221, 310

[56] References Cited

U.S. PATENT DOCUMENTS 4,105,968 8/1978 Mobley et al. ..... 439/131 X 4,647,832 3/1987 Fenne et al. ..... 439/131 X

FOREIGN PATENT DOCUMENTS 3535564 5/1986 Fed. Rep. of Germany .

64-48386 2/1989 Japan .

*Primary Examiner*—Larry I. Schwartz

*Assistant Examiner*—Khiem Nguyen

*Attorney, Agent, or Firm*—Ernestine C. Bartlett

[57] ABSTRACT

An electrical apparatus is provided in which in the situation as shown in FIGS. 1–4 in which power inlet pins are exposed, a user can use the electric appliance by connecting A.C. cord 20 to power inlet pins 5 without danger that a user might touch slide plugs 4 because they are completely covered by slide cover 7. In this situation, if a user pushes finger actuating portion 8 of slide cover 7 in the direction as shown by an arrow in FIG. 4, power inlet pins 5 are covered by slide cover 7 and slide plugs 4 protrude out of plug slits 32 by rotation of pinion gear portion 3 which engage with rack gear 17 and 18 as shown in FIGS. 5 and 6. In this situation, the electric appliance can be charged with slide plugs 4, while power inlet pins 5 are covered by slide cover 7, so that there is no danger that a user might touch power inlet pins 5.

6 Claims, 5 Drawing Sheets

RECHARGEABLE ELECTRIC APPARATUS

The present invention relates to portable rechargeable electric appliances such as shavers or flash lights.

BACKGROUND OF THE INVENTION

Portable shavers provided with rechargeable batteries and a device to recharge them are known. There are two ways to recharge the rechargeable batteries contained in the shaver. One of them is to supply electrical power to the shaver through an electrical cord, while the other is to do the same by plugging sliding plug blades protruded from a body housing of the shaver into a receptacle arranged on a wall of a house. However, in the former case, the electrical cord is always necessary for recharging, while in the latter case the shaver can not be used during recharging of the battery of the shaver or when the batteries are not recharged enough.

To solve these problems a shaver in which the sliding plug blades for recharging are provided and the electrical cord can be also used, has been proposed. This kind of a shaver is disclosed in (Japan) Utility Model Laid-open No. 1-40,134, which will be explained with reference to FIGS. 9 and 10.

FIGS. 9 and 10 show the lower part of body housing 1 in a conventional shaver. Fixed terminal 21 with power inlet pin 5 into which electrical cord 20 is plugged, is arranged on one side of body housing 1, while slots 28 from which sliding plug blades 4 can be extracted for recharging are arranged on the other side. Two sliding plug blades 4 are fixed on both sides of plug support 22 which is made of insulating material. Recess 23 is formed at the central portion of the plug support 22, which recess accommodates operating knob 24 together with spring 29. There are formed lock grooves 25*a, b* to be engaged with the operating knob 24 at the base of the body housing 1. Sliding electrode 27 connected to fixed terminal 21 and sliding electrode 26 connected to electric circuits of the shaver are in contact with the top of the sliding plug blades 4.

FIG. 9 shows the situation in which the sliding plug blades 4 are retracted in the body housing 1 (an electrical cord mode). In this situation electrical power is provided to the shaver via the electrical cord 20 connected to power inlet pin 5, which power is provided to electric circuits through the sliding electrode 27, the sliding plug blades 4 and the sliding electrode 26.

FIG. 10 shows the situation in which the operating knob 24 pushed upwardly by a finger, so that a lock state with lock groove 25*a* is released, is being moved toward lock groove 25*b*. When the operating knob 24 is engaged with lock groove 25*b*, the sliding plug blades 4 are pushed out from slots 28, which enables one to recharge the shaver by the sliding plug blades 4 plugged into a power receptacle (a plug blade mode). In this case, since the sliding electrodes 27 are in contact with plug support 22 made of insulation material, the electric circuit between fixed terminal 21 and sliding electrodes 26 is cut off, so that electrical current is provided to the shaver not by electrical cord 20 but by the sliding plug blades 4.

The above-mentioned rechargeable shaver may cause a problem that a user receives an electric shock, when he happens to touch the sliding plug blades 4 with a metal piece or the like through an opening of the body housing 1 which is arranged for a path where operating knob 24 moves. Furthermore, since the distance between the top of sliding plug blades 4 and the outside surface of slot 28 is only about 0.5 mm when the sliding plug blades 4 are retracted within body housing 1, that is, under the electrical cord mode, a user may receive an electric shock when his finger touches the top of sliding plug blades 4 through the slot 28 when he grips the shaver.

In addition, switching circuits are necessary in order to avoid the situation wherein current is provided to power inlet pin 5 so that a user receives an electric shock if he touches power inlet pin 5 while the shaver is being recharged by the sliding plug blades 4, that is, under the plug blade mode.

SUMMARY OF THE INVENTION

An object of the invention is to provide a solution for the above described problem and to improve the operation of the shaver.

The rechargeable electric apparatus of the present invention is characterized in comprising

- a first compartment is provided with power inlet pins to which an electrical cord is connected,
- a second compartment, adjacent to the first room, which accommodates plugs supported by a plug support provided with a rack gear, current collecting means contacting with the plug, a pinion gear assembly having a first pinion gear and a second pinion gear, and plug slits out of which the plugs protrude, and a sliding cover made of a resilient material for covering a part of an exposed surface of the first and second compartments, a rack gear being provided on a part of an underside of said sliding cover, wherein the first pinion gear and the rack gear provided on the plug support are coupled, and the second pinion gear and the rack gear of the sliding cover are coupled.

Under the electrical cord mode in which a user uses the shaver of the invention with the electrical cord inserted into the power inlet pin, the plug blades to be used for recharging the batteries are encased in the second compartment and are completely covered with the sliding cover. Accordingly, there is no possibility of an accident in which the user of the shaver receives an electric shock by touching the plug blades.

On the other hand, under the plug blade mode in which the rechargeable battery is recharged by the plug blades protruded from the plug slit and plugged into the electric receptacle, since the first compartment is completely covered by the sliding cover, there is likewise no chance that the user receives an electric shock by touching the power inlet pins.

If the sliding cover is moved by a finger, a rack gear provided on the underside of the sliding cover engages with the second pinion gear so that a pinion gear assembly rotates. This rotation moves the rack gear provided on the plug support engaging with the first pinion gear, which enables the plug blades to be extracted from the plug slits and retracted into the second compartment.

A finger actuating portion provided on a part of the sliding cover enables easy movement of the sliding cover.

It is possible to provide a lock mechanism by a protrusion provided on the body housing and a latch provided on the inside of the sliding cover.

The electric apparatus of the present invention is especially suitable for shavers and flash lights.

According to the portable rechargeable electric apparatus of the present invention, either of the sliding plug blade or the power inlet pin which is not being used, is always covered by the sliding cover completely, so that there is no possibility that a user receives an electric shock by touching plugs or pins when current is provided.

In addition, the portable rechargeable electric apparatus of the present invention needs no switching arrangement for exchanging the plug blade mode and the electrical cord mode.

BRIEF DESCRIPTION OF THE DRAWINGS

Example of the rechargeable electric apparatus of the present invention applied to a shaver will be explained with reference to drawings in which.

DETAILED DESCRIPTION OF THE PREFERRED EMBODIMENTS

Figure 1:
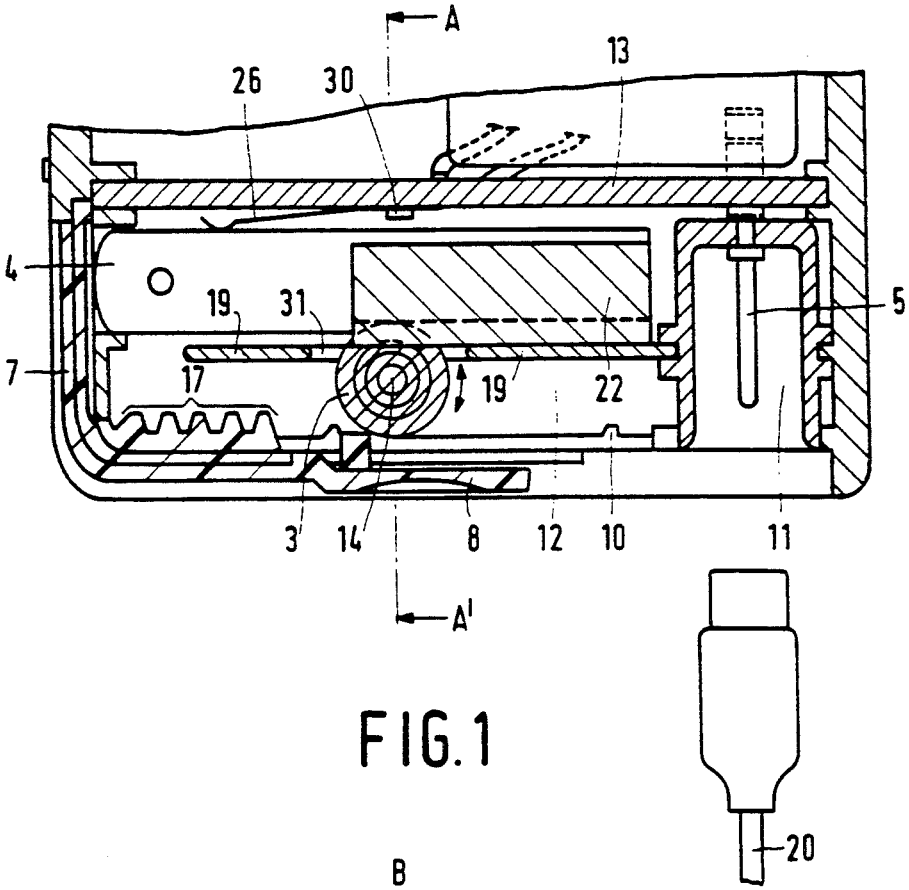
FIG. 1 is a cross-sectional view of a shaver in accordance with the present invention in the situation in which an electrical cord can be used.
Figure 2:
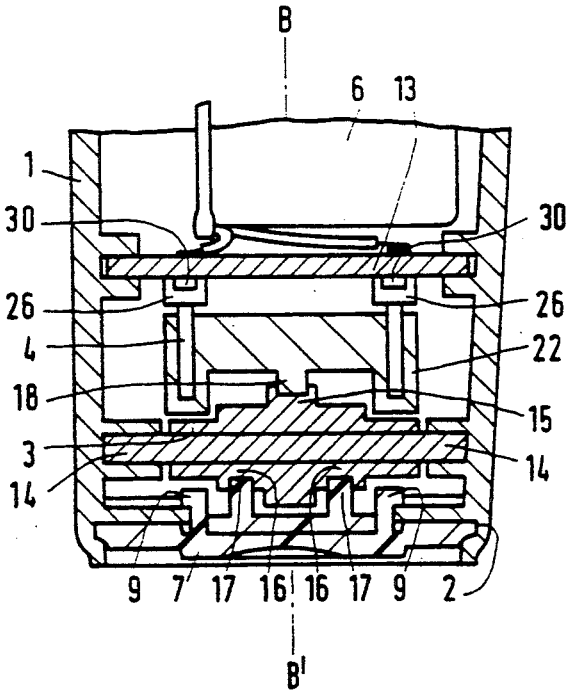
FIG. 2 is a cross-sectional view taken on line A—A' of the shaver in FIG. 1.

With reference to FIGS. 1 and 2, wall 13 is arranged at a lower portion of the shaver, and there are provided first compartment 11 and second compartment 12 below the wall 13. Power inlet pin 5 is provided in the first compartment 11 such that electrical cord 20 can be inserted. The other end of the power inlet pin 5 is connected to electric device (such as rechargeable batteries 6) installed in the compartment above the wall 13.

Figure 6:
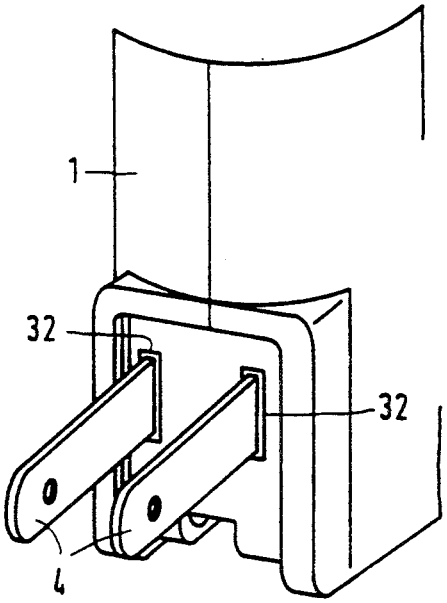
FIGS. 6 and 7 show respectively the part of sliding plug blades and the part of the sliding cover of the shaver in the situation of FIG. 5.

Intermediate wall 19 separates the second compartment 12 into an upper part and a lower part, which upper part accommodates sliding electrodes 26 and a pair of sliding plug blades 4 separated at a definite separation by plug support 22. Plug slits 32 are arranged at the place of the body housing which is in the direction to which sliding plug blades 4 move (refer to FIG. 6). Pinion gear member 3 is provided under intermediate wall 19.

As shown in FIG. 1, a pair of sliding electrodes 26 are fixed with fixing member 30 on the lowerside of the wall 13 in such a way that each end of those electrodes always contacts one of the sliding plug blades 4. On the other hand, as shown in FIG. 2, the other ends of those sliding electrodes 26 are connected to electric devices (such as rechargeable batteries 6) installed in the compartment above the wall 13.

Figure 4:
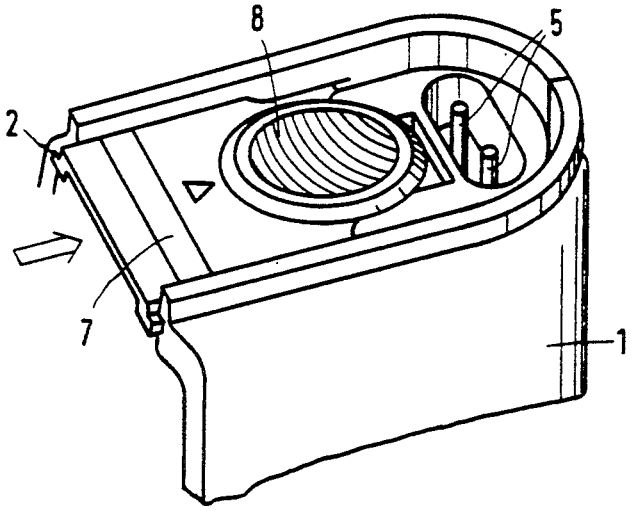

Sliding cover 7 is arranged to cover partly the outside surface of the first compartment 11 and the second compartment 12. Finger actuating portion 8 is arranged on one end of the top face of sliding cover 7 as shown in FIG. 4. On the inside face of the sliding cover 7 two latches 9 are arranged at both sides of the place corresponding to the circumference of the portion 8 which place is remote from the end of the sliding cover 7, and there is provided rack gear 17 at the place which is further remote from that end. As shown in FIG. 2, both side ends of the sliding cover 7 are formed thinner than its central portion, which end engages with guide groove 2 arranged on the lowest end of body housing 1 so that sliding cover 7 can slide.

Figure 8:
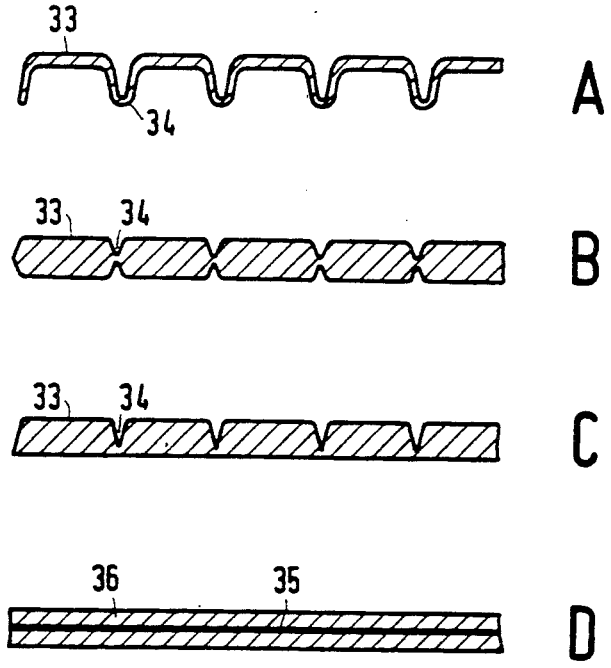
FIG. 8 shows examples of the sliding cover of the present invention.
Figure 9:
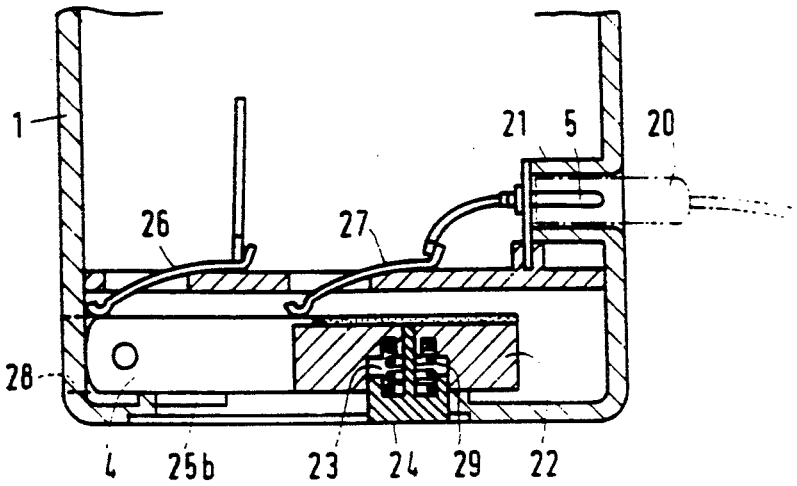
FIG.9 PRIOR ART
FIGS. 9 and 10 show a shaver of the prior art.
Figure 10:
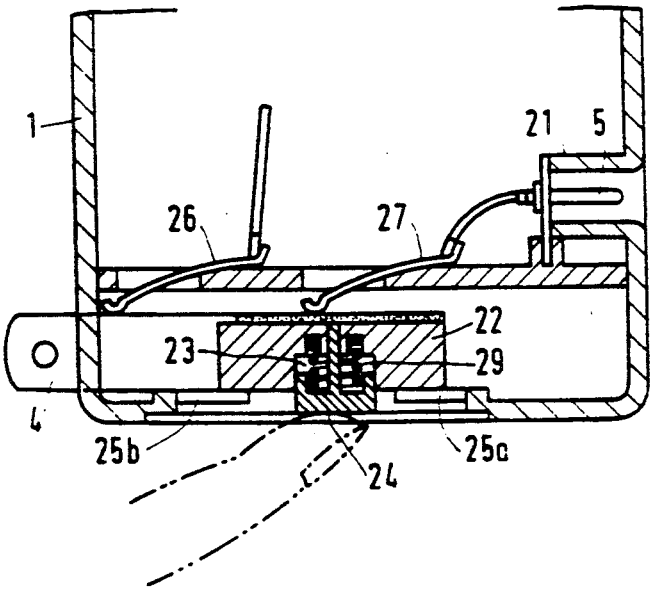
FIG.10 PRIOR ART

The sliding cover 7 covering the outside surface of the first and second compartments changes its moving direction 90° at the corner of the second compartment when moving. Therefore, it is desirable to make the sliding cover 7 of a resilient material. However, it is possible to provide the resilient sliding cover 7 by making it suitably thin without using such resilient material. In addition, it is possible to constitute sliding cover 7 by forming a thick portion 33 and a thin portion 34, as shown in FIGS. 8A, B and C, or by passing soft material 36 to hard material 35 as shown in FIG. 8D.

As shown in FIGS. 1 and 2, pinion gear member 3 is secured to the body housing at the central portion of the second compartment 12 in the longitudinal direction so as to rotate with respect to shaft 14. Pinion gear member 3 comprises first pinion gear 15 and second pinion gear 16. The gear ratio of the first pinion gear 15 and the second pinion gear 16 is 1:1.4–1.5. The top end of the first pinion gear 15 engages with rack gear 18 provided on the lower central part of the plug support 22 through an opening provided on intermediate wall 19. The second pinion gear 16 engages with rack gear 17 provided on the inside face of sliding cover 7.

A pair of sliding plug blades 4 are held at a desired separation by the plug support 22 made of insulating material. The rack gear 18 is provided on the lower central portion of the plug support 22.

Figure 3:
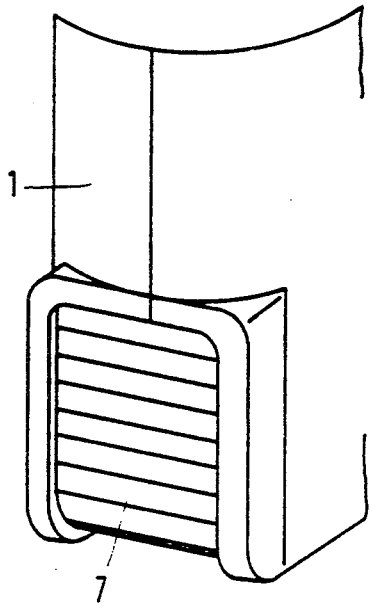
FIGS. 3 and 4 show respectively the part of a sliding plug blade and power inlet pins covered with a sliding cover in the shaver of FIG. 1.

FIGS. 1–4 illustrate the operation of the electrical cord mode. In this operation mode, as shown in FIGS. 1 and 3, sliding plug blades 4 are completely encased in the second compartment 12 and their front ends are covered by the sliding cover 7. On the other hand, as shown in FIG. 1 and FIG. 4, since the first compartment 11 is completely exposed, it is possible to provide the shaver with power by connecting electrical cord 20 to power inlet pin 5. In this situation, the first pinion gear 15 of pinion gear assembly 3 engages with rack gear 18, while the second pinion gear 16 does not engage with rack gear 17.

Figure 5:
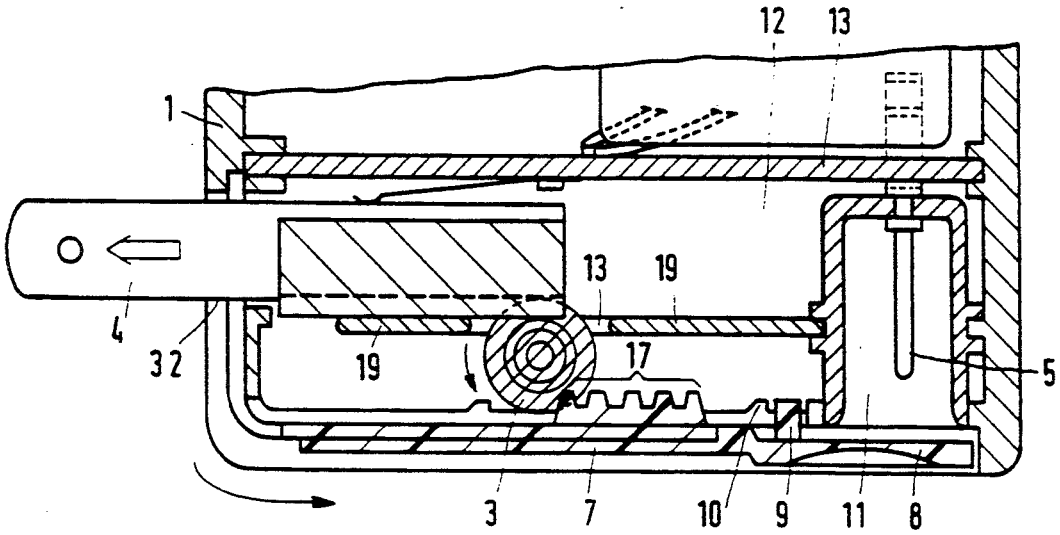
FIG. 5 is a cross-sectional view of the situation in which sliding plug blades of the shaver of the present invention are extracted.

To change the electrical cord mode to the sliding plug blade mode, a user puts a finger on finger actuating portion of sliding cover 7, and then moves the sliding cover 7 in the direction shown by an arrow in FIG. 4. When the sliding cover 7 moves for a definite distance, rack gear 17 of the sliding cover 7 engages with the second pinion gear 16 of the pinion gear assembly 3. After this, movement of the sliding cover 7 in the direction shown by an arrow in FIG. 4 causes the pinion gear assembly 3 to rotate in the direction shown by an arrow in FIG. 5. The first pinion gear 15 always engages with the rack gear 18 provided on plug support 22, when pinion gear assembly 3 rotates in the direction shown by an arrow in FIG. 5. Therefore the sliding plugs 4 will move in the direction shown by the arrow so that they are extracted from plug slits 32. As shown in FIG. 5, if the finger actuating portion 8 moves further in the direction shown by an arrow, latch 9 of the sliding cover 7 will get over protrusion 10 provided on bottom board of the body housing 1, and then stop at the location shown in FIG. 5. Since the protrusion 10 and the latch 9 constitute a lock mechanism for the sliding cover 7 when it is at the location shown in FIG. 5, the situation in which the first compartment 11 is completely closed as shown in FIG. 7 is maintained unless the user releases its lock state by pushing down the circumference of the finger actuating portion 8.

Figure 7:
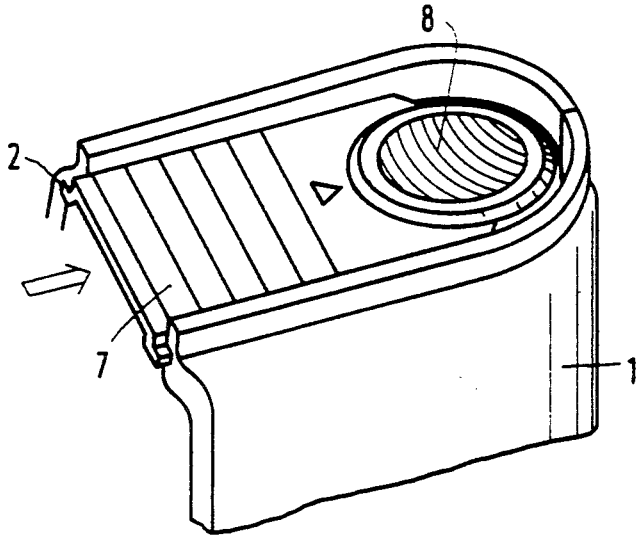

If a user releases the lock state of the sliding cover 7 shown in FIG. 7 and forces it to move against the direction of an arrow in FIG. 7, the situation shown in FIG. 1 will be obtained again.

There is no need to provide a rack gear 17 on the whole face of the sliding plug blades 4, as long as it is possible for the sliding cover to move between the location in which the sliding plug blades 4 are completely extracted from plug slits 32 and the location in which the sliding plug blades 4 are completely retracted in the second compartment 12.

I claim:

1. A rechargeable electric apparatus which is rechargeable by use of either an electrical cord or plug blades comprising:

a first compartment provided in the body housing with power inlet pins to which an electrical cord is connected, a second compartment adjacent to the first compartment, which accommodates plug blades supported by a plug support provided with a rack gear, current collecting means contacting with the plug blades, a pinion gear assembly having a first pinion gear and a second pinion gear, and plug slits provided in the housing out of which the plug blades protrude, and a sliding cover made of resilient material for covering a portion of exposed surfaces of the first and second compartments, a rack gear being provided on a portion of an underside of said sliding cover wherein the first pinion gear and the rack gear provided on the plug support are engaged, and the second pinion gear and the rack gear of the sliding cover are engaged.

2. An electric apparatus as claimed in claim 1 wherein a finger actuating portion is provided on a part of the sliding cover.

3. An electric apparatus as claimed in claim 1 wherein a protrusion is provided on a body housing, a latch is provided on the inside of the sliding cover, and the protrusion and the latch constitute a lock mechanism for the sliding cover.

4. An electric apparatus as claimed in claim 1 wherein the sliding cover comprises a thick portion and a thin portion.

5. A shaver comprising the electric apparatus as claimed in claim 1.

6. A flash light comprising the electric apparatus as claimed in claim 1.

* * * * *